United States Patent [19]

Hanert et al.

[11] 4,139,932

[45] Feb. 20, 1979

[54] METHOD FOR WINDING AND FORMING OF COOLING COILS

[75] Inventors: Eckehard Hanert, Sennestadt; Anton Ehlen, Warburg, both of Fed. Rep. of Germany

[73] Assignee: Benteler-Werke AG, Paderborn, Fed. Rep. of Germany

[21] Appl. No.: 872,003

[22] Filed: Jan. 24, 1978

Related U.S. Application Data

[62] Division of Ser. No. 733,020, Oct. 15, 1976, Pat. No. 4,085,488.

[30] Foreign Application Priority Data

Oct. 18, 1975 [DE] Fed. Rep. of Germany ..... 2546766

[51] Int. Cl.[2] ..... B21D 53/02; B23P 15/26

[52] U.S. Cl. ..... 29/157.3 R; 29/33 T; 29/727; 72/137; 72/217; 140/92.2

[58] Field of Search ..... 29/157.3 R, 726, 727, 29/33 G, 33 T; 72/137, 161, 183, 216, 217; 140/71.5, 92.2

[56] References Cited

U.S. PATENT DOCUMENTS

| | | | |
|---|---|---|---|
| 1,802,161 | 4/1931 | Summers | 29/727 X |
| 2,510,183 | 6/1950 | Luce | 72/217 X |
| 2,514,830 | 7/1950 | Bath | 72/183 |
| 2,683,474 | 7/1954 | Langenberg | 140/92.2 |
| 2,697,868 | 12/1954 | Arant | 29/157.3 R |

*Primary Examiner*—Othell M. Simpson
*Assistant Examiner*—Z. R. Bilinsky
*Attorney, Agent, or Firm*—Michael J. Striker

[57] ABSTRACT

A method for forming cooling coils of successive layers of rectangular configuration, in which the front end of an elongated tube is threaded between rolls of a straightening apparatus and clamped onto the periphery of a rectangular table, whereafter the table is rotated about a central axis while the incoming tube shifted in direction of this axis, and while the tube upstream of the table is held in taught condition by the straightening apparatus so that the tube is wound into a coil of rectangular configuration about the table. After a coil of predetermined length has thus been wound, the table is stopped, the tube cut between the straightening apparatus and the table and the cut rear end of the tube is also clamped to the table. Thereafter, the corner portions of all loops of the coil are simultaneously formed by stamping into outwardly bulging portions to thereby stretch the tube sections between the corner portions beyond the elastic limit of the tube material; and an apparatus for carrying out the aforementioned steps in automatic succession.

3 Claims, 15 Drawing Figures

METHOD FOR WINDING AND FORMING OF COOLING COILS

This is a division, of application Ser. No. 733,020, filed Oct. 15, 1976 now U.S. Pat. No. 4,085,488.

BACKGROUND OF THE INVENTION

The present invention relates to a method and apparatus for winding cooling coils with a plurality of successive superimposed layers of rectangular configuration with stamped corners.

Cooling coils of rectangular configuration are used for refrigeration appliances, especially deep freezer chests. The cooling coils are delivered in finished form to the manufacturer of the refrigeration appliance for assembly. The manufacture of cooling coils of the aforementioned shape has up to now been carried out in a plurality of separate manufacturing steps. The tubes are straightened in a straightening machine and thereafter cut to a predetermined length. Subsequently thereto the thus-prepared tubes are bent into coils with a semi- or fully-automatic winding-up machine. To finish form the bent corners of the coil it is customary to place the pre-bent tube coil between the tools of a hydraulic press to simultaneously form a set of corners by stamping. Thereby, it is usually necessary to place the coil four times in turned positions into the press, i.e., according to the number of corners of the coil. The up to now used method comprises, therefore, three operating steps, i.e., tube straightening, tube bending, and stamping of the corners, whereby the last step usually requires placing the bent tube four times into the press.

While, due to the automatic bending of the coil, a simplification of this bending process is obtained, the known process has still the disadvantage that the bent coil has to be subsequently transported and placed into a press which complicates the manufacture and leads often to rejects.

SUMMARY OF THE INVENTION

It is an object of the present invention to improve and simplify the manufacture of cooling coils of the aforementioned kind.

It is a further object of the invention to provide a method and apparatus for the manufacture of cooling coils of the aforementioned kind by which the finished coils can be produced in a single continuous operation without the necessity to transport the partly finished coil from one to another machine, to thus avoid any damage to the coil.

With these and other objects in view, which will become apparent as the description proceeds, the apparatus of the present invention for winding cooling coils of substantially rectangular form with outwardly bulging stamped corner portions mainly comprises a winding table of rectangular configuration rotatable from a start position about a central axis, at least four rolls respectively mounted in the region of the corners of the rectangular table and each movable in radial direction between an inner winding position and an outer forming position, at least four punch means arranged for cooperation with the rolls and each movable between an outer starting position outwardly spaced from the table to permit rotation of the latter about its axis and an inner forming position closely adjacent to the rolls, first moving means cooperating with the rolls for moving the same between the positions thereof, second moving means connected to said punch means for moving the same between said positions thereof, means for clamping the front end of an elongated tube to be wound into a coil to the table, means for rotating the table about said axis after the front end of the tube has been clamped thereon while the rolls are in said inner winding position and the punch means are in the starting position so that the tube will be wound in a coil about the rolls on the corners of the table, means upstream of the table for maintaining the tube during winding thereof in taught condition, tube guide means between the upstream means and the table and movable in direction of said axis and in a direction transverse thereto, means cooperating with the tube guide means for moving the latter in the direction of said axis during rotation of the table about its axis, and control means for actuating the first moving means to move the rolls from the inner winding position to said outer forming position and said second moving means to move said punch means from said outer starting position to said inner forming position to therby form said outwardly bulging corner portions while stretching the tube portions between said corner portions when the table after having made a predetermined number of revolutions about its axis has returned to said rest position.

The aforementioned means upstream of the table for maintaining the tube during winding thereof in taught condition, preferably comprise tube straightening means and reel-off means for a coiled tube upstream of the straightening means, and the apparatus includes further cutting means between the tube guide means and the winding table for cutting the tube after a coil of predetermined length has been wound.

The leading end of the tube to be wound is fed, in the arrangement according to the present invention, by the straightening machine over the tube guide means to a clamping device on the winding table and the leading end remains clamped to the table during the winding, stamping and stretching of the tube and is released only when the coil is completely finished. The tube guide means according to the present invention will assure that the tube is transmitted without kinks from the straightening machine to the winding table. During feeding of the front end of the tube to the winding table, the rolls of the straightening machine are driven, and after the leading end of the tube is clamped to the table and the latter rotated, a coupling in the drive of the rolls of the straightening machine is released so that the tube is now drawn by the rotating table between the rolls of the straightening machine so that the latter holds the tube during winding thereof into a coil in tensioned condition.

It is an essential feature of the present invention that the tube sections between the rolls from the winding table, during forming of the outwardly bulging corners of the coil, are stretched beyond the elastic limit of the tube material. In this way a rigid, exact shape of the finished coil is derived, suitable for transport and subsequent assembly in a cooling appliance. In using the apparatus according to the present invention, the manufacture of the cooling coils is not only greatly simplified, but coils of such close tolerances and stability are produceable as has been so far considered impossible to obtain by people skilled in the art.

Such a coil is especially suitable for semi-automatic assembly with the other elements of a cooling appliance.

In certain cases it is not possible to manufacture the inner or outer containers of the deep freezer chests or other refrigeration appliance with such close tolerances as are obtainable for the cooling coils. In such cases it is further suggested in accordance with the present invention to curve the straight tube sections of the coil after winding by engagement with curving segments of very large radii and to subsequently stretch the tube sections over such curved segments.

For cooling coils, which are mounted in the appliance about an inner container, the tube sections are inwardly curved to assure, even when the container is manufactured with large tolerances, a good contact between the latter and the cooling coils.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
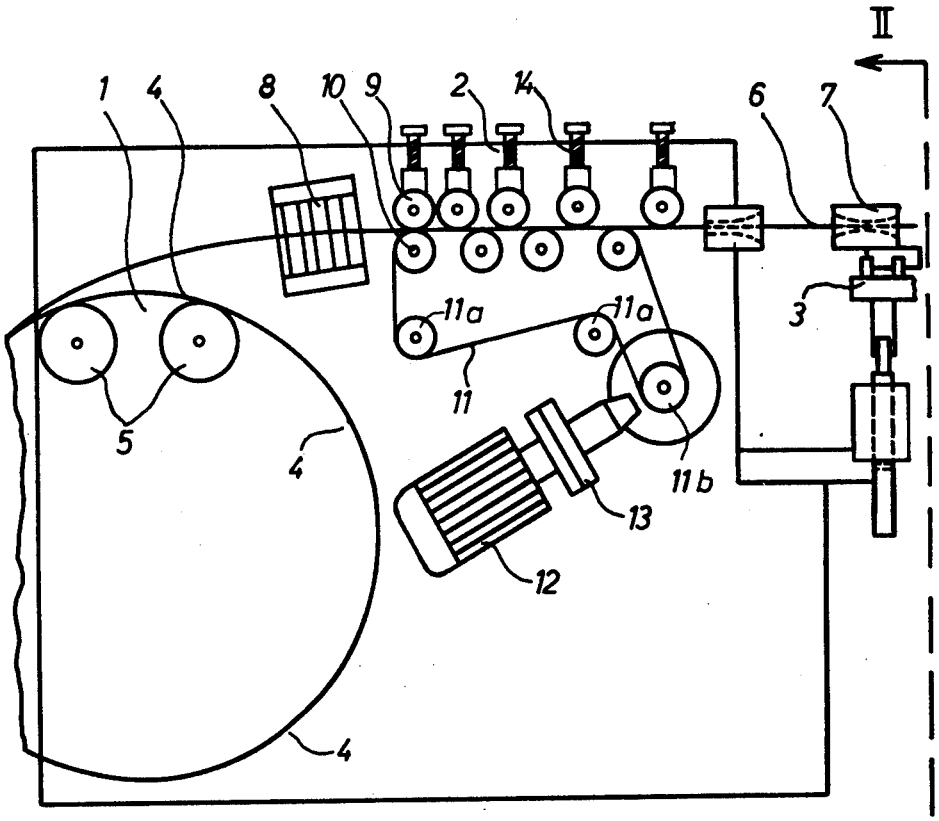
FIG. 1 is a schematic side view of the reel-off means, the straightening means and the tube guide means according to the present invention.
Figure 5:
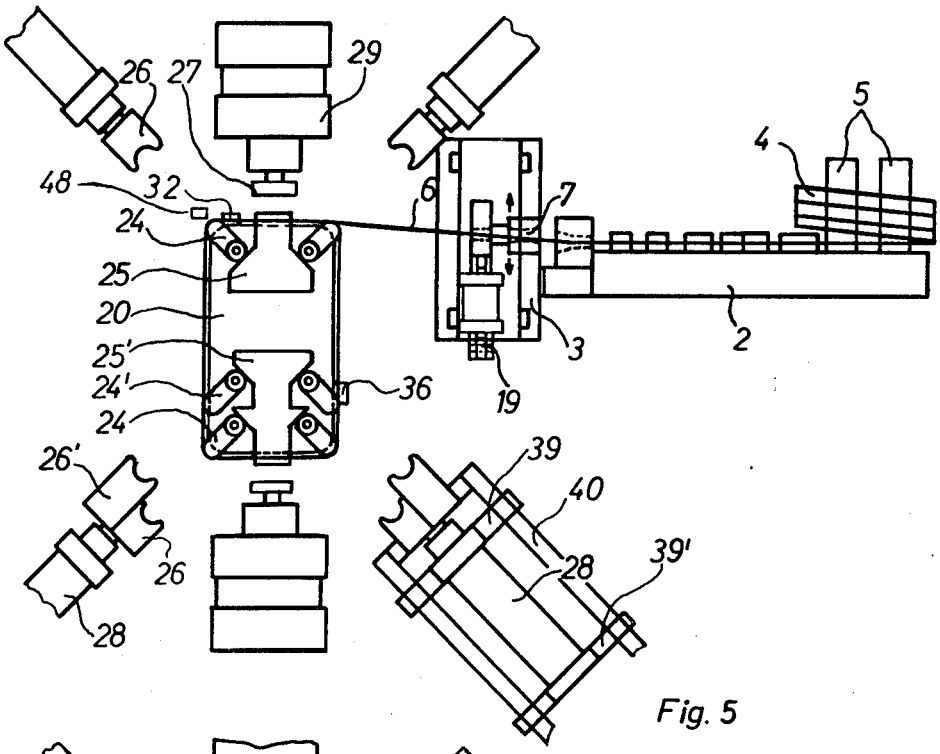
FIG. 5 is a schematic top view of the reel-off means, the guide means, the cut-off means and the winding table and elements cooperating therewith and showing the winding table in a predetermined rest or start position.

FIG. 1 schematically illustrates the elements of the arrangement according to the present invention which are located upstream of a winding table 20, shown in FIG. 5 and following. As can be seen in FIG. 1, there is provided a reel-off means 1 including transport rolls 5 about which an elongated tube coil is placed. A straightening machine 2 for straightening the coil 4 is arranged downstream of the reel-off means 1, and the tube passing from the reel-off means 1 to the straightening machine 2 is laterally guided by rolls 8.

The straightening machine 2 comprises a plurality of rolls 9 and 10 respectively arranged to engage a tube 6 passing therebetween on opposite sides thereof. The first of the rolls 9 and 10, as considered in the direction of movement of the tube 6, are rotatable about axes located in a plane normal to the direction of movement of the tube, while the axes of the following rolls are offset with respect to each other in the aforementioned direction. Means 14, of known construction and only schematically illustrated in FIG. 1, are provided to adjust the position of each roll 9 in a direction normal to the axis of the tube 6. At least the rolls 10 can be driven by drive means schematically shown in FIG. 1 and including an endless chain 11 guided over the rolls 10, guide rolls 11*a* and a drive roll 11*b*, which in turn may be rotated from a drive motor 12 over a preferably electromagnetic coupling 13.

Figure 2:
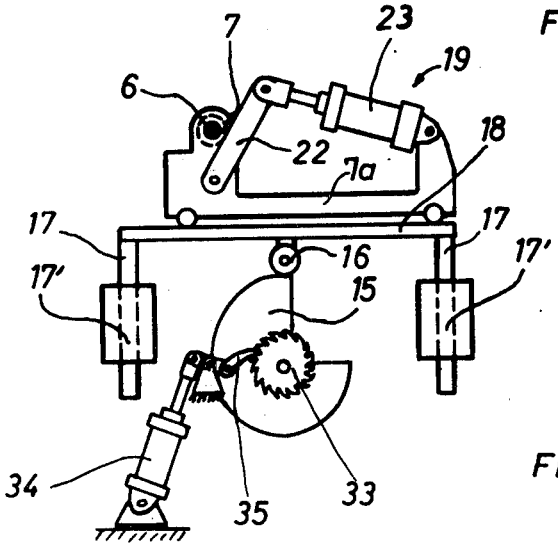
FIG. 2 is an end view of the tube guide means of FIG. 1 as seen in the direction of the arrows II—II of FIG. 1.

Guide means 3 are provided downstream of the straightening machine 2 for guiding the tube 6 to the winding table 20. The guide means 3 include, as best shown in FIG. 2, a carriage 7*a* carrying a guide funnel 7 through which the tube 6 passes. The carriage 7*a* is mounted on rails 18 movable in a direction transverse to the axis of the funnel 7 and the rails 18, in turn, are movable in vertical direction on post 17 respectively guided in stationary guide sleeves 17'. A roller follower 16 fastened to the rails 18 rides on the peripheral surface of a cam 15 rotatable in clockwise direction about a fixed axis by means of a ratchet wheel 33 fixed thereto and a ratchet pawl 35 oscillated by cylinder-and-piston means 34 so that the funnel 7 may be raised in correspondence with the winding of the tube 6 in successive superimposed layers about the table 2 in the manner as will be described below.

Cutter means 19 are carried by the carriage 7*a* for cutting the tubes between the funnel 7 and the table 20. The cutting means 19 include a cutting knife 22 pivotally mounted at its lower end on the carriage 7*a* adjacent the rear end of the funnel 7 and hydraulically operated cylinder-and-piston means 23 connected to the other end of the knife 22 for turning the latter in counterclockwise direction about its lower end to thereby cut the tube 6. The cutting means 19 may also include spring press members 22' arranged to opposite sides of the cutting knife 22 for flattening the tube ends during the cutting operation.

Figure 3:
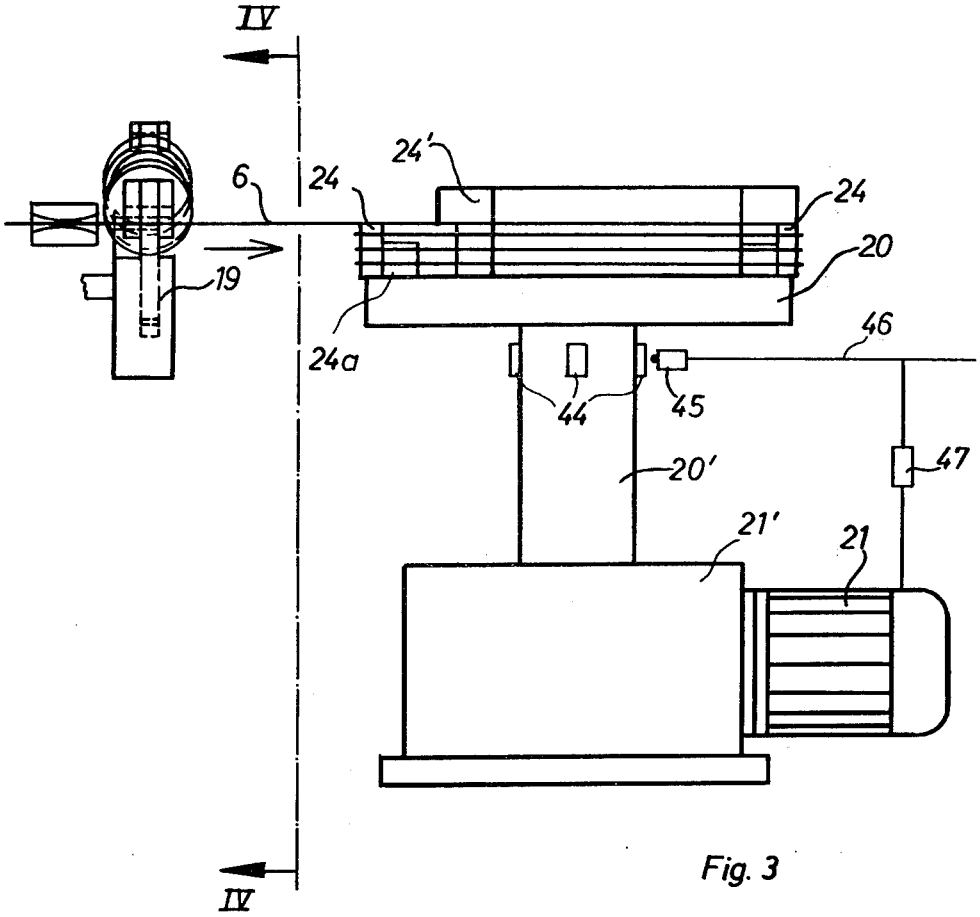
FIG. 3 is a schematic side view of the cutting means and the winding table.
Figure 4:
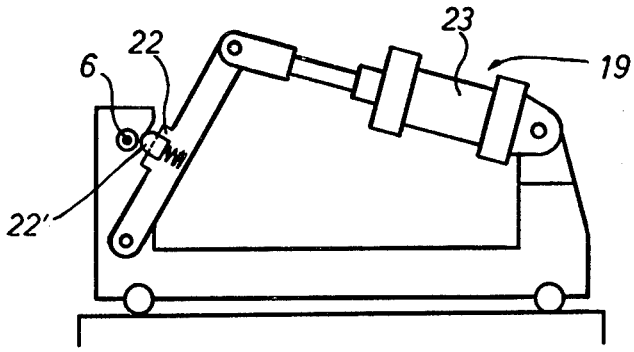
FIG. 4 is an end view of the cutting means as seen in the direction of the arrows IV—IV of FIG. 3.

FIG. 5 schematically shows in a top view the apparatus for winding the tube into a coil of rectangular configuration and for forming or stamping the corner portions of the coil. This apparatus comprises a winding table 20 of rectangular outline rotatable about a central axis and carrying at least in the region of the corners thereof upright rolls 24, the lower ends of which are provided with shoes 24*a* (FIG. 3) which are guided in dove-tail grooves 38 provided in the table 20 (FIGS. 10 and 11) for movement in radial direction as will be described later on. FIG. 5 shows the table 20 in its start position in which the leading end of the tube 6 is clamped by schematically shown clamping means 32 to the table 20. The table 20 is mounted on a hollow shaft 20' (FIG. 3) which is rotatable by means of a motor 21 and a gear reduction drive of known construction in a gear box 21'. The hollow shaft is provided on its outer periphery with a plurality of for instance four or more cams 44 uniformly spaced from each other in circumferential direction and cooperating during rotation of the table 20 with a stationary switch 45 in a control circuit 46 connected thereto to impart electrical impulses to a solenoid-operated valve, not shown in the drawing, for actuating the cylinder-and-piston means 34 driving the cam disc 15 of the tube guide means 3. The control circuit 46 includes also a counter 47 connected to the circuit 46 for supplying the electrical motor 21 with electrical energy so that after the table 20 has carried out a predetermined number of revolutions and after a predetermined number of impulses has been imparted to the valve of the cylinder-and-piston means 34, current supply to the motor is interrupted and the table 20 arrested in a predetermined position shown in FIG. 5.

Figure 6:
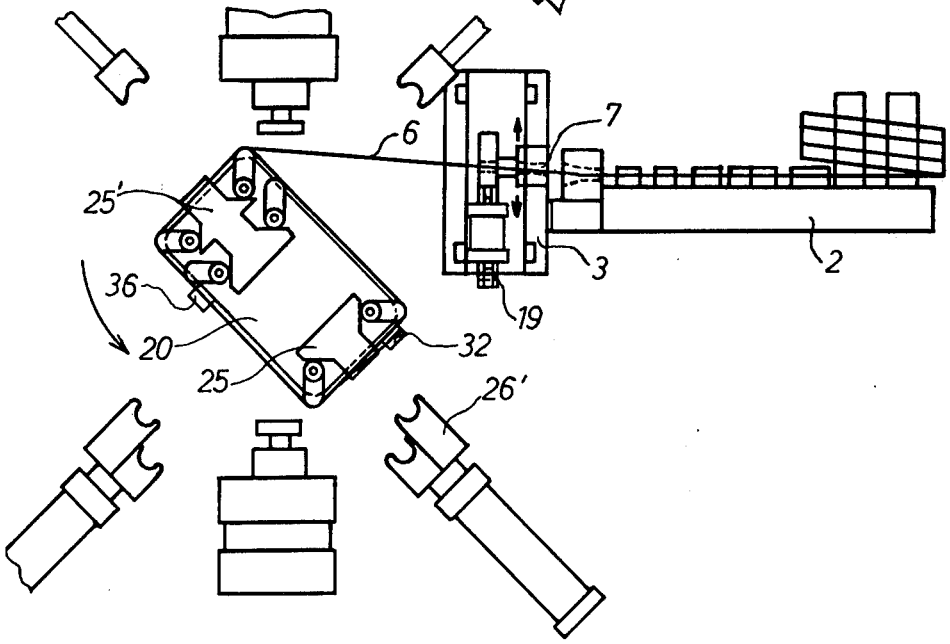
FIG. 6 is a top view similar to FIG. 5, but showing the winding table in a turned position.

First moving means are provided for moving the rolls 24 in radial direction along the guide grooves 38. These first moving means comprise a pair of oppositely arranged wedge members 25, 25' mounted on the table 20 for movement toward and away from each other and respectively engaging with inclined faces of the rolls 24 as schematically shown in FIGS. 5 and 6. The first moving means includes further a pair of fluid-operated cylinder-and-piston means 29 respectively connected to the wedge members 25 and 25' by a coupling means 27 schematically shown in FIG. 5 and in further detail in FIGS. 14 and 15. As shown in the last-mentioned two Figures, each cylinder-and-piston means 29 is mounted at its rear end tiltable about a fixed axis 29', and the piston rod of a stationarily mounted auxiliary cylinder-and-piston means 29*a* is connected over a crank lever 37 to a hook-shaped coupling member 27, which in turn is connected to the piston rod of the cylinder-and-piston means 29 to move the hook-shaped member 27 between the positions shown in FIGS. 14 and 15 respectively coupling the wedge-shaped member 25 or 25' to the cylinder-and-piston means 29, or to uncouple the latter from the respective wedge member.

If upper layers of the wound coil should have shorter sides than lower layers thereof, then the table 20 is provided with a pair of additional rolls 24', as shown in FIGS. 5 and 6, arranged on the longer sides of the rectangular table 20 between the rolls 24 at the table corners, and the wedge member 25' is provided with additional inclined faces cooperating with the additional rolls 24' as shown in FIGS. 5 and 6. In this case the rolls 24 adjacent the rolls 24' are shorter than the other pair of rolls 24 and the lower ends of the additional rolls 24' are at the level of the upper ends of the rolls 24 adjacent thereto. If, on the other hand, all layers of the coil are to be wound with equal length, the rolls 24' are removed and rolls 24 of equal length are provided in the region of the four corners of the table 20.

The rolls 24 and 24' are held in engagement with the inclined faces of the wedge members 25 and 25' by springs not shown in the drawing.

Figure 13:
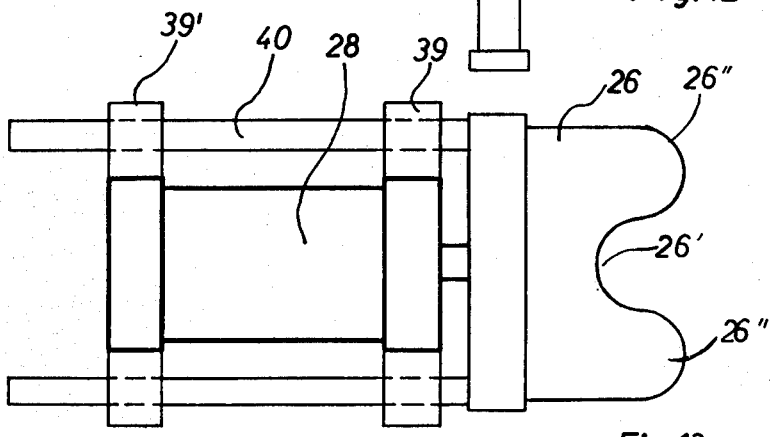
FIG. 13 is a top view of one of the punches and the moving means therefor.

The winding and forming apparatus includes further four punches 26 arranged for cooperation with the rolls 24. If the additional rolls 24' are used, two of the punches 26 are also provided with additional punch members 26', as shown in FIGS. 5 and 6, which may be releasably connected to the punch members 26 to be removed when the additional rolls 24' are not in use. Second moving means in the form of fluid-operated cylinder-and-piston means 28 are connected to the punches 26 for moving the latter and the punch members 26', when used, between an outer starting position, shown in FIGS. 5 and 6, permitting free rotation of the table 20 and an inner forming position shown in FIGS. 8 and 11. As best shown in FIG. 13, guide rods 40 connected to the punches 26 and extending through bores in the guide members 39 laterally projecting from the cylinders 28, prevent undesirable turning of the punches 26 about the axes of the cylinders 28. Each of the punches is provided at its front end with a substantially semi-circular groove 26' bounded by substantially semi-circular convex portions 26".

The rolls 24 and 24' are provided, at least at the outer surface portions thereof adapted to engage the tube to be wound, with a number of locating portions or grooves 24" according to the number of layers of the coil to be wound, and the grooves on successive rolls are offset in vertical direction at least through a distance corresponding to a quarter of the diameter of the tube 6.

Figure 12:
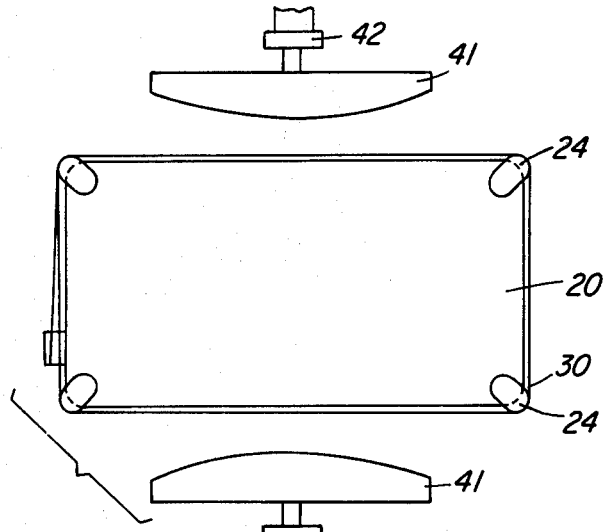
FIG. 12 is a view similar to FIG. 7 and additionally showing curving segments for curving the tube sections between the corners.

The apparatus may also include curving means comprising segments 41, having a front face curved along a large radius and being movable by cylinder-and-piston means 42 into engagement of tube sections extending along the larger sides of the rectangular table 20, when the table, after winding a coil thereon, is arrested again in the position as shown in FIG. 12.

The table 20 is further provided with second clamping means 36 for clamping the trailing end of the cut tube to the table.

Figure 7:
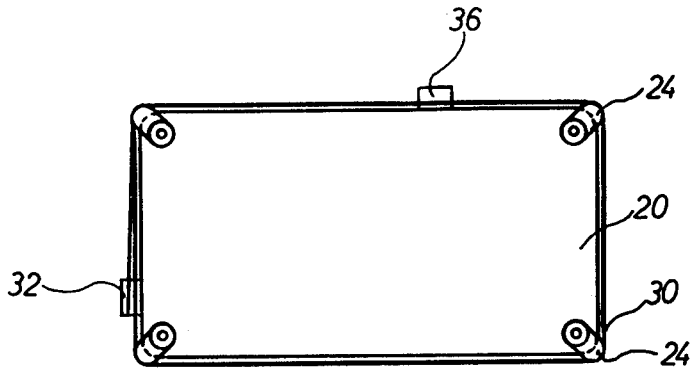
FIG. 7 is a schematic top view of the winding table with the rolls thereon in an inner winding position.
Figure 10:
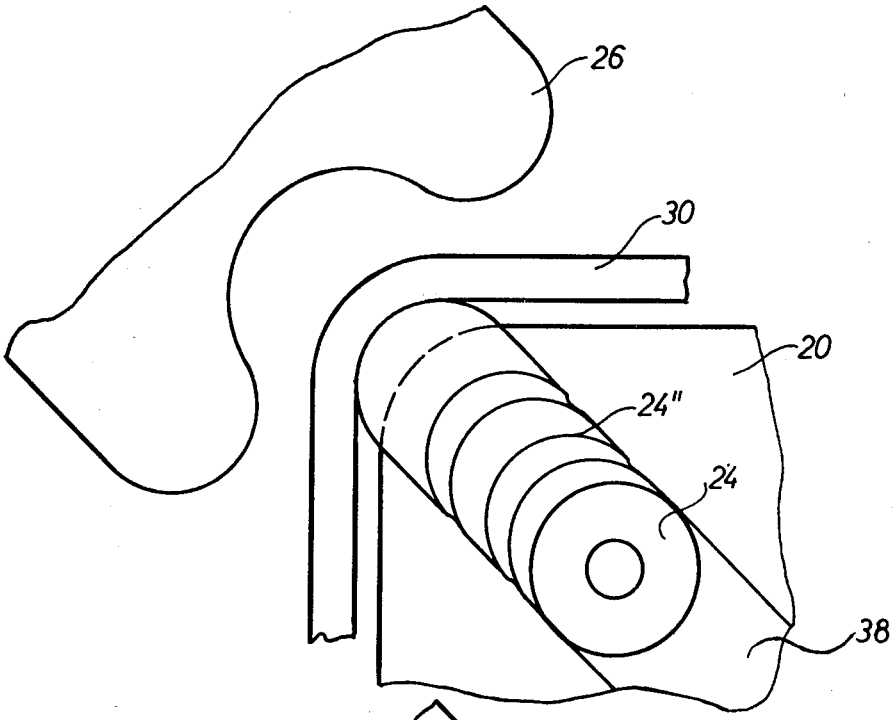
FIG. 10 is a partial schematic view of one roll and a punch cooperating therewith during winding of a tube.

The above-described arrangement will be operated as follows:

The leading end of the coil 4 on the reel-off means 1 is guided by hand between the rolls 8 into the nip between the first rolls 9 and 10 of the straightening machine 2. The rolls 10 are then driven by energizing the motor 12 and the clutch 13 so that the leading end of the table passes between all the rolls of the straightening machine and through the funnel 7 towards the clamping means 32 on the table 20 held in its start position as shown in FIG. 5. The leading end of the tube 6 is then clamped to the table by the clamping means 32. A switch 48 is arranged adjacent the clamping means 32 so as to be actuated during operation of the clamping means and the switch 48 is connected to a control circuit 46 to deenergize, when actuated, the clutch 13 and to energize the motor 21 to rotate the table 20 about its axis. The tube 6 upstream of the table 20 is thus pulled between the rolls 9 and 10 of the straightening apparatus by the rotating table, so that the tube between the straigtening apparatus 2 and the winding table 20 is maintained in tension condition. During rotation of the table 20, the rolls 24, as well as the rolls 24', when in use, are held on the table in an inner winding position as shown in FIGS. 5, 7 and 10 while the carriage 7*a* carrying the guide funnel 7 may shift along the rails 18 and the rails 18 are moved in vertical direction by the turning cam 15 and the cam follower 16 connected to the rails. In this way, the tube 6 is guided without kinks toward the rolls on the table 20 and wound in a coil about the latter while successive coil layers are shifted in upward direction.

After the table has carried out a predetermined number of revolutions, the counter 47 will deenergize the drive motor 21 and the table will be arrested in a rest or starting position as shown in FIG. 7. The cutting means are then actuated and the trailing end portion of the cut tube is bent by hand against the table 20 and clamped thereon by the second clamping means 36. The two clamping means 32 and 36 are located on the table in correspondence with the location of connecting means in the appliance in which the finished coil is to be used.

Figure 8:
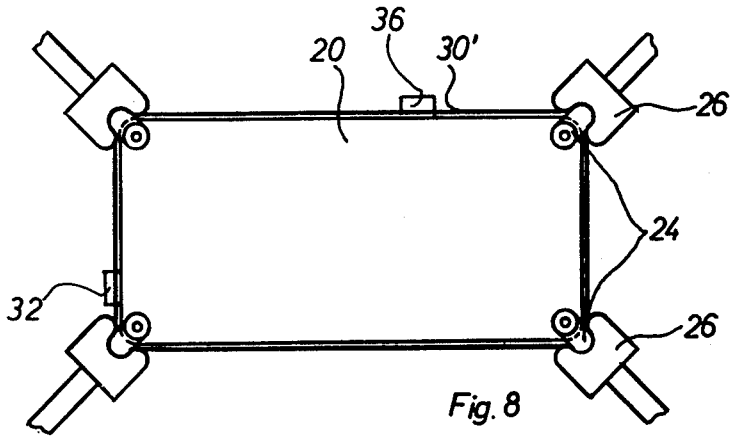
FIG. 8 is a view similar to FIG. 7, but showing the rolls and the punch means cooperating therewith in the forming positions thereof.
Figure 9:
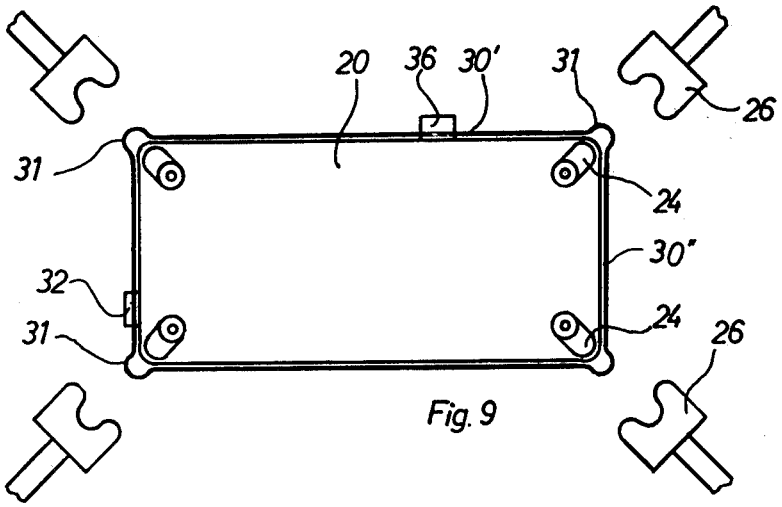
FIG. 9 is a view similar to FIG. 8, but showing the rolls and the punch means in a position for withdrawing the coil.
Figure 11:
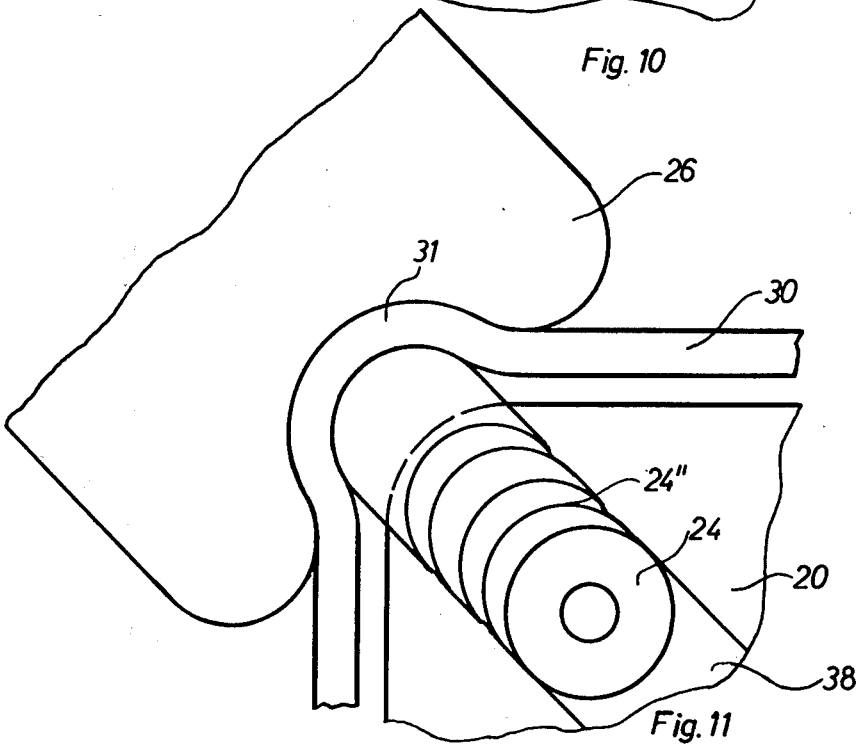
FIG. 11 is a view similar to FIG. 10, but showing the rolls and the punch cooperating therewith in position during forming of the outwardly bulging corner portions of the coil.
Figure 14:
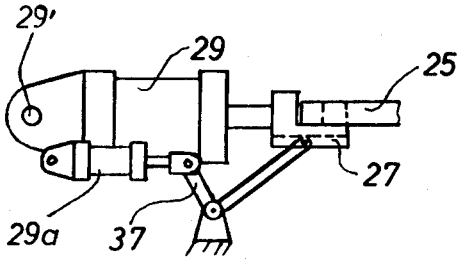
FIG. 14 is a partial schematic side view of the moving means for moving the rolls on the table between the positions thereof, including hydraulic means and a coupling member.
Figure 15:
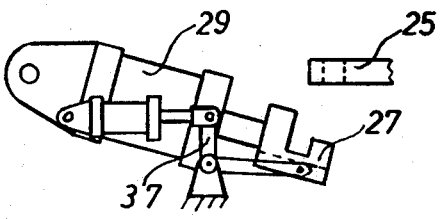
FIG. 15 is a view similar to FIG. 14, showing the coupling member in a released position.

Subsequently thereto the cylinder-and-piston means 29 are actuated, while the coupling means 27 thereof are in the engaged position as shown in FIG. 14 to move the wedge members 25, 25' away from each other to thereby move each of the rolls 24 on the table 20 from the inner winding position thereof to an outer forming or stamping position as shown in FIGS. 8 and 11. Simultaneously with the movement of the rolls 24, the punches 26 are moved by the second moving means 28 from the outer starting positions shown in FIG. 5 to the inner forming positions as shown in FIGS. 8 and 11 to thereby form or stamp the corners of the wound tubular coil into outwardly bulging corner portions 31 as best shown in FIGS. 9 and 11. During forming of the bulging corner portions 31, the straight tube sections 30' and 30'' between the corner portions are stretched beyond the elastic limit of the tube material. If the segments 41, as shown in FIG. 12, are used, they are moved into engagement with the tube sections 30', before the outwardly bulging corner portions 31 are formed so that the tube sections 30' are stretched over the segments 41.

After the tubular coil has been formed into its final shape, the punches 26 are again withdrawn to their outer starting positions and the rolls 24 on the table are preferably moved to a withdrawal position as shown in FIG. 9 slightly inwardly spaced from the winding position shown in FIG. 7, by appropriately moving the wedge members 25 and 25' toward each other to facilitate withdrawal of the finished coil from the winding and forming apparatus.

The wedge members 25 and 25' are each self-lockable arrestable in three positions corresponding to the winding, forming and withdrawal positions of the rolls cooperating therewith.

It is to be understood that other control means than shown and described may be used for actuating the ratchet mechanism shown in FIG. 2. Thus electronic control means or a punched tape moved by rotation of the table 20 may be used for imparting impulses to the operating valve for the cylinder-and-piston means 34. An additional switch may also be arranged for cooperation with the second clamping means 36 to be actuated by the latter during the clamping of the trailing end of the tube to thereby actuate the cylinder-and-piston means 28 and 29 during clamping of the trailing end of the tube.

It will be understood that each of the elements described above, or two or more together, may also find a useful application in other types of winding and forming apparatus for cooling coils differing from the types described above.

While the invention has been illustrated and described as embodied in an apparatus for winding a cooling coil of rectangular configuration with outwardly bulging corner portions, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of forming cooling coils comprising the steps of clamping the leading end of an elongated tube to the periphery of a rectangular table provided at the four corners thereof with upright rolls; rotating the table about a vertical axis while maintaining the tube portions of the table in taught condition; displacing the incoming tube during rotation of the table in direction of said axis in correspondence with the speed of rotation of the table so that the tube is wound in a coil of successive layers of rectangular configuration about the rolls at the corners of the table; arresting the table after a coil of predetermined length has been wound; simultaneously forming the corners of each layer of the coil into outwardly bulging portions by moving the rolls in radially outward direction and by stamping the corner portions with punches moving inwardly toward the rolls to thereby stretch the tube sections between the corner portions beyond the elastic limit of the tube material.

2. A method as defined in claim 1, wherein the step of maintaining the tube upstream of the table in taught condition comprises the step of passing the tube upstream of the table between the rolls of a straightening apparatus.

3. A method as defined in claim 2, and including the step of cutting the tube between the straightening apparatus and the table after a coil of predetermined length has been wound, and clamping the trailing end of the tube to the table, said leading and said trailing end of the tube remaining clamped to the table during forming of said outwardly bulging corner portions.

* * * * *